United States Patent [19]

Babsch et al.

[11] Patent Number: 4,836,699

[45] Date of Patent: Jun. 6, 1989

[54] OPERATOR PANEL FOR PRINTERS

[75] Inventors: Alfred Babsch, Ulm-Soeflingen; Lorenz Fromme, Oepfingen, both of Fed. Rep. of Germany

[73] Assignee: Mannesmann AG, Duesseldorf, Fed. Rep. of Germany

[21] Appl. No.: 24,417

[22] Filed: Mar. 11, 1987

[30] Foreign Application Priority Data

Mar. 11, 1986 [DE] Fed. Rep. of Germany ..... 3607945

[51] Int. Cl.[4] ..... B41J 5/10

[52] U.S. Cl. ..... 400/479; 400/711; 340/711; 341/23

[58] Field of Search ..... 400/479, 711, 477; 340/365 S, 711

[56] References Cited

U.S. PATENT DOCUMENTS

| | | | |
|---|---|---|---|
| 3,962,698 | 6/1976 | Hunt et al. | 340/711 X |
| 3,967,273 | 6/1976 | Konowlton | 400/477 X |
| 4,454,501 | 6/1984 | Butts | 340/365 S X |
| 4,527,917 | 7/1985 | Ueno | 400/479 X |
| 4,558,315 | 12/1985 | Weiss et al. | 340/365 S X |

FOREIGN PATENT DOCUMENTS

| | | | |
|---|---|---|---|
| 1417848 | 12/1985 | United Kingdom | 400/477 |
| 8700124 | 1/1987 | World Int. Prop. O. | 400/711 |

OTHER PUBLICATIONS

IBM Tech. Disc. Bulletin, "Indicator Display", Bagley, vol. 11, No. 3, Aug. 1988, pp. 281-282.

IBM Tech Disc. Bulletin, "Phantom Switch Mode for Printer on Other Apparatus", Zimmerman, vol. 25, No. 4, Sep. 1982, pp. 2191-2192.

*Primary Examiner*—Edgar S. Burr
*Assistant Examiner*—James R. McDaniel
*Attorney, Agent, or Firm*—Ralf H. Siegemund

[57] ABSTRACT

An operator panel for printers which includes visible function indicators as well as trigger elements for controlling printer functions has a single function operating and indicating field arranged in a matrix fashion with lines and columns wherein the lines indicate classes of functions and wherein a particular column includes designations as well as indications for the classes of functions; there is at the most one indication and/or one designation in any matrix intersection, a single key is associated with each of the columns; a second panel field is disposed alongside the first one, having a single operating key, and being individually organized commensurate with the lines and in a single column but being independent from said designations of the particular column.

3 Claims, 1 Drawing Sheet

OPERATOR PANEL FOR PRINTERS

BACKGROUND OF THE INVENTION

The present invention relates to an operator panel for printers, particularly matrix printers, and includes indicating instruments and/or trigger elements (e.g. keys, etc. buttons) for various purposes such as turning the printer on and off, for connecting the printer to one or more data sources, for operating the paper transport, for paper end signaling, for manual stepping through lines, for positioning and threading-in the paper as well as for programming the printer in accordance with particular text requirements, printer quality, change over from high to low speed operations etc.

The above identified steps for operating a printer are exemplary only and can well be continued. Basically this will depend on the sophistication and degree of complexity of the printer and on aspects of replacing automation by semi-automation or just plain manual operation as to any of the different steps that are required for printer operation. The number of steps that can be controlled manually are to some extent limited by the interface configuration by means of which the printer is connected to a computer or any other data processing facilities, and again the degree of complexity of that computer on one hand and the degree of complexity of the print operation, on the other hand, is controlling here, including for example escapes, sequences or the like. The operator panel may also offer a indication of whether the printer is on/off, when and where paper ends, or any selectivity in its operation, and there may be an indication of whether the printer is, at this point in time, is ready to receive data.

An operator panel of the type to which the invention refers to above and constituting a point of departure for the present invention is used in the so-called MANNESMANN TALLY printer MT140. This printer includes in particular the following panel features. There are six keys i.e. the key SEL for selection operation (operational turning on/off); a test key for performing specific test run operation; two yes/no keys and to the right thereof a single line key LF, particularly, and for feeding a single sheet into the printer or pulling the sheet out again. Below that key LF is a key FF for continuous, fast paper transport, e.g. until the next format has entered the printer. Moreover, there are certain LED-s for indicating generally the state of the circuit, the selectivity, whether or not paper end has passed and so forth. The diodes are arranged one above the other and are identified accordingly also, the keys are labeled appropriately.

DESCRIPTION OF THE INVENTION

It is an object of the present invention to provide a new and improved operator panel with an operating field that is systematically organized as to function by way of keys, labels and indication.

In accordance with the preferred embodiment of the present invention, the object is attained in that the panel is divided into a (larger) single function field and a (smaller) multi (or complex) function field. The single function operating field is organized in a matrix having lines and columns and the elemental areas of this field are the intersections of the lines and columns. The several lines are provided for function classification and each column is associated with but one key. Each of these lines is identified with a designation or an identification and all of these designations or identifications are arranged in one column, one above the other. Within each line one or several, single functions (but only one per intersection) are specifically designated and fall under the particular line classification. In some cases, the intersection is left empty. The complex function field is organized in a single column that flanks the above identified matrix, with a single key in the same line as the keys of the single function field, and thus, fits into the overall matrix pattern.

This organizational scheme of inter-relating indicating functions and trigger and keying functions, call for an assignment of related functions and their indication to one and the same line in terms of classifying designation, while functions that are operationally unrelated, are organized in columns; they can be triggered by one and the same key, the various keys occupying, e.g. the lowest line within the matrix pattern. This arrangement potentially maximizes the number of indicating/trigger functions while permitting, for a simpler version, simply the leaving empty of those matrix intersections that are not needed in that version. The overall configuration is easier to interpret and visual identification of functions is simplified.

Each "occupied" intersection is to be provided with an indicator such as an LED, an illuminated incremental field or the like.

The key which is associated with the line classification column should be associated with a cyclically operating step switch to scan from line to line. This then resolves the inherent ambiguity of any of the single function column keys. The key for the multi function column (field) should also be associated with and operate a step switch.

From a different point of view, it is suggested to provide a primary operator field in a matrix fashion organized in lines and columns wherein the lines indicate classes of functions and the columns indicate unrelated functions, and wherein in each line-column intersection there is but one indication, and for each column there is but one operating key.

The organization of the primary field in an operator panel in accordance with the invention thus orders related functions and separates visually unrelated functions, so that, on one hand, the functions are organized in classes which are arranged in a line while, on the other hand, in each line column, intersection needs but one operator key. This way, one is able to expand a given operator field to obtain what is believed to be the maximum possible function indications and triggering with maximum ease of recognition and operational decipherment by an operator.

The panel area may be constructed as a result of functional constraint, but optimizes the number of simple functions that can be accommodated. On the other hand, it may happen that individual functions are difficult to classify, and in furtherance of the invention, it is suggested to associate the aforementioned field, but still within the line-column matrix pattern with a supplemental field that provides for complex functions, e.g. by way of a single column in which each individual matrix position is made multiple use of. It is important, however, that that particular function field is limited to a well defined area separated from the first mentioned single function field and panel area wherein but a single function is assigned to a matrix point. This way, complexities are not needlessly and in an unorganized fashion intermixed with single function locations.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the invention, FIG. 1 illustrates an operator panel and indicating field 1 indicating a plurality of functions which an operator is to control, trigger, stop, observe or the like, from the front of a printer and without having to go directly to (or through) a computer by way of a particular command sequence to be entered through the computer panel. In other words, the printer is, to the extent of these panel functions, largely autonomous. These so-called parameter functions include broadly the turning on and off of the printer, but such a function is usually provided for in a redundant fashion. Once, as a single prower turn-on and off switch to the side or in the rear of the printer, and an operational turning-on and off, often called, selection. There should be, however, an indication whether or not the printer is actually turned on, regardless from where this function obtains and a lamp or the like should indicate on the front panel whether or not the printer is, in fact, on. In addition, operational connection of the printer to (or separation from) a data source should be indicated, so should be the state of the paper transport, line stepping, relevant information or paper positioning, programming of the printer, test status, print quality identification, as well as the state of storing these parameters, all have to be indicated. Also any defect, error or the like should be indicated.

Figure 1:
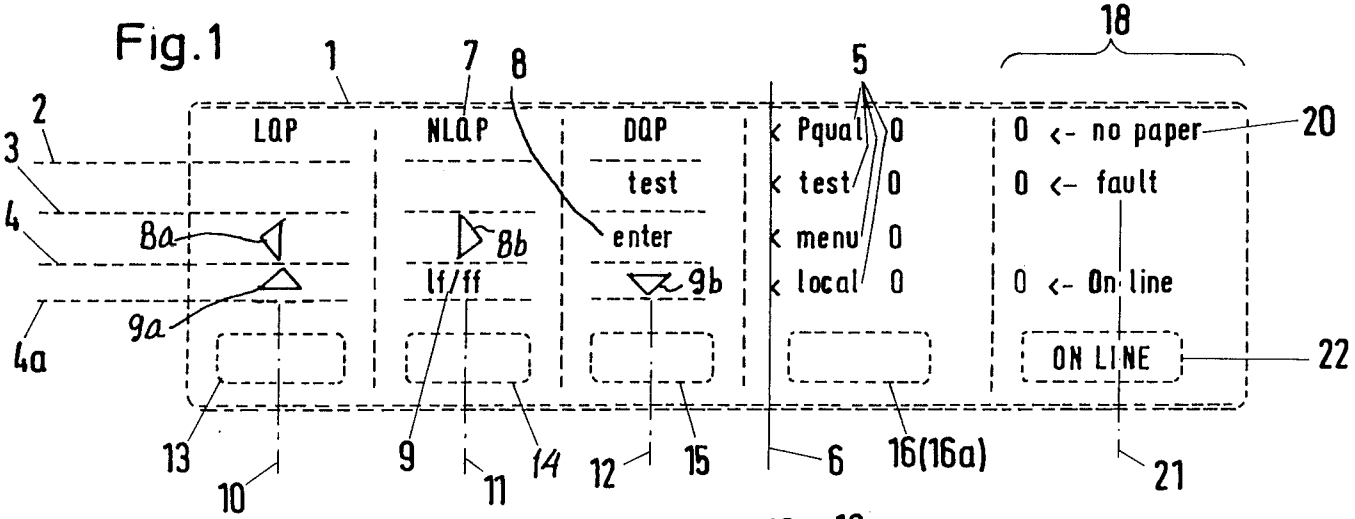
FIG. 1 is a top elevation of an operator panel in accordance with a first example for the preferred embodiment of the present invention for practicing the best mode thereof.
Figure 2:
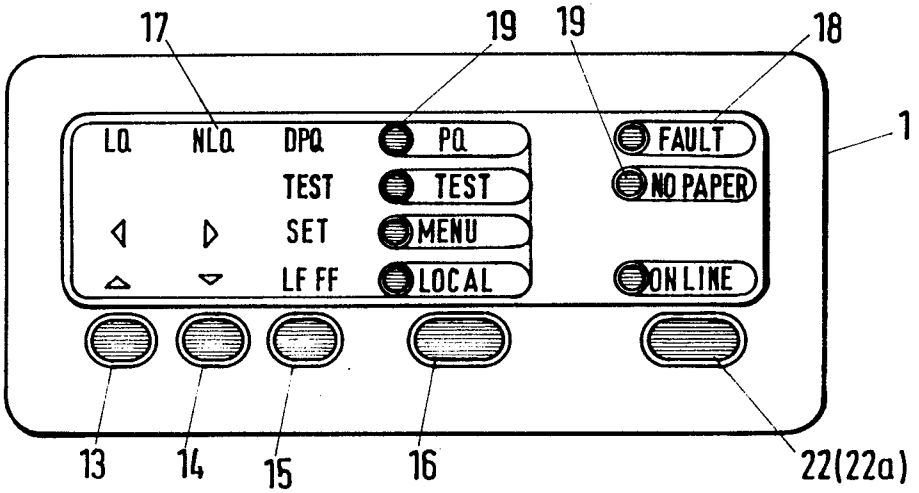
FIG. 2 is a top elevation of an operator panel and field constituting a second functionally expanded example of the preferred embodiment of the present invention.

In order to have the field of view organized in an appropriate and convenient fashion with the smallest possible area being occupied by the panel, but under consideration of permitting logically an increasing of the number of parameter functions that have been indicated and/or triggered, it is suggested to organize the panel in the following matrix pattern.

Reference numerals 2, 3, 4, 4*a* refer to four different lines each of which represent a class of functions. These functions are designated and identified under 5 in a matrix column 6. The line 2 particularly contains a designation which is related to the print quality (Pqual); the quality being letter quality (LQP), near letter quality printing (NLQP) and high speed printing (DQP), as identified in three other positions of that line. Line 3 includes printer "test" as well as certain free functions not yet assigned. Line 4 indicates "menu" and the term "enter" in the same column as "test", provides the horizontally printed menu selection under utilization of the print head of the printer. This obtains by having the printhead either move to the right (indication 8*a*) or to the left (indication 8*b*) obtained by key operation to be described below. As soon as the desired menu position obtains the respective parameter can now be programmed by pressing the "enter" button. The fourth line (4*a*) of classes of function includes the various steps for moving the paper such as line advance or format advance (eg/ff) and the direction of paper advance indicated by arrows 9*a* and 9*b* in two different columns. All designations of the lines 2, 3, 4, 4*a* are found in one column, namely column 5. This column can also be called the classification designating column.

The designations of single functions within the various classes are organized in columns 10, 11, and 12. Each of these individual function columns 10, 11, 12 are associated with separate trigger key or operator button, respectively, designated 13, 14, and 15 in the lowest matrix line. The classification designating column 6 has also just one trigger key 16. In order to render the instantaneous positions of the line stepping switch immediately and directly recognizable, each of the aforementioned classification lines 2, 3, 4, 4*a*, particularly in column 6, are associated with an indicating device 19 so that for each of the individual function columns the matrix intersection is directly determinable by the line indication and by what ever key the operator pushes. This indication 19 is comprised, e.g. in an instance of an illuminating diode or LED next to appropriate labeling.

The viewing panel matrix, thus, has the three single function columns 10, 11, 12, wherein column 10 holds the LQP, the head movement indicator to the left (8*a*), the paper advance up or forward 9*a*, and the key 13 by means of which the respective function obtains. The situation is analogous in columns 11 and 12. The keys 13, 14, and 15 are single on/off keys or buttons. The key 16 triggers and steps an (electronic) "rotary" switch to step through one line after the other which will be appropriately indicated and in addition, each function line and class so identified, becomes enabled in the sense that the operation of a particular column key will be effective in the respective line-column intersection. Thus, if by means of key 16 the class selection has stepped to line 4, and key 15 is activated, then the position of the matrix head at that point is manifested in some form and entered for further use. The individual functions associated with each particular line such as 2, 3, 4, 4*a* constitute a first part of the operator viewing panel 17.

Complex indicating functions such as "no paper", "fault", and "computer on line" are arranged in a second operator field 18. This second partial field of view 18 includes also diodes or other appropriate LEDs. The second panel and field of view 18 indicates complex functions which are arranged in a column 21. The associated key 22 is likewise connected with a step switch 22*a* which corresponds to the switch 16*a*. Alternatively the fields can be divided through an LC display whereby the respective functions are emphasized through size or outlining of the corresponding markings.

The invention is not limited to the embodiments described above but all changes and modifications thereof, not constituting departures from the spirit and scope of the invention, are intended to be included.

We claim:

1. Operator panel for printers which includes visible function indicators as well as trigger elements for controlling printer functions comprising:

an operating and indicating field arranged in a matrix fashion with lines and columns wherein the lines indicate classes of printer functions, and wherein a particular column includes designations as well as indications for the classes of the printer functions;

an intersection of a line of a column including at the most one indication and/or one designation;

a single key separated from and associated with each of the columns whereby keys associated with the particular column select only designations and indications associated with that column and keys associated with columns other than the particular column select the respective column with which such a key is associated; and said key in said particular column operating a step switch to run through the line class indications one by one and on a cyclic basis to thereby select the respective line.

2. Operator panel as in claim 1, and including a second panel field disposed alongside the first one, having a single operating key, and being individually organized commensurate with said lines, and in a single column, but being independent from said designations of the particular column.

3. Panel as in claim 2, said single operating key also being or operating a step switch to run through the line class indications one by one and on a cyclic basis.

* * * * *